US005329737A

United States Patent [19]

Roberts et al.

[11] Patent Number: 5,329,737

[45] Date of Patent: Jul. 19, 1994

[54] CERAMIC BUILDING BLOCK

[75] Inventors: Peter A. Roberts, Alfred; Kevin G. Hayes, Dansville; Joanne M. Peek, Alfred Station, all of N.Y.

[73] Assignee: PolyCeramics, Inc., Alfred, N.Y.

[21] Appl. No.: 137,621

[22] Filed: Oct. 15, 1993

Related U.S. Application Data

[63] Continuation-in-part of Ser. No. 739,875, Aug. 2, 1991, Pat. No. 5,261,194.

[51] Int. Cl.[5] ..... E04B 1/32

[52] U.S. Cl. ..... 52/245; 52/DIG. 10; 52/249; 52/284; 52/608

[58] Field of Search ..... 52/245, 249, 80.1, 81.1, 52/81.5, 284, 286, 568, 586, 587, 608, 612, DIG. 10

[56] References Cited

U.S. PATENT DOCUMENTS

| | | | |
|---|---|---|---|
| 3,953,009 | 4/1976 | Kan | 52/249 |
| 4,429,506 | 2/1984 | Henderson | 52/284 |
| 4,522,006 | 6/1985 | Plikuhn | 52/245 |
| 4,532,748 | 8/1985 | Rotherham | 52/608 |
| 4,753,622 | 6/1988 | Nakama | 52/608 |
| 5,170,598 | 12/1992 | Kadar et al. | 52/245 |

FOREIGN PATENT DOCUMENTS

| | | | |
|---|---|---|---|
| 0629092 | 3/1962 | Belgium | 52/608 |
| 0337344 | 10/1989 | European Pat. Off. | 52/DIG. 10 |

*Primary Examiner*—Carl D. Friedman
*Assistant Examiner*—Christopher Todd Kent
*Attorney, Agent, or Firm*—Howard J. Greenwald

[57] ABSTRACT

An arcuate building structure containing at least three five-sided building blocks, at least three six-sided building blocks, and means for connecting one of said five-sided building blocks to at least one of said six-sided building blocks. The top side of the six-sided block has a substantially triangular shape, and is substantially parallel to the bottom side of the six-sided block. The front side of the six-sided block has a substantially trapezoidal shape with a top edge, a bottom edge, a right edge, and a left edge. The right edge and the left edge have equal lengths and form equal angles with the bottom edge. The back side of the six-sided block has a substantially triangular shape with at least two sides equal in length to each other. The left and right sides of the six-sided block are congruent with each other, are in the shape of a parallelogram, and contain a recess within their borders. The five-sided block contains a top side with a substantially rectangular shape and a recess disposed within such shape, a left and right side (each of which are congruent with the left and right sides of the six-sided block), and a front and back side (each of which are congruent with each other and with the back side of the six-sided block).

9 Claims, 11 Drawing Sheets

FIG. 6
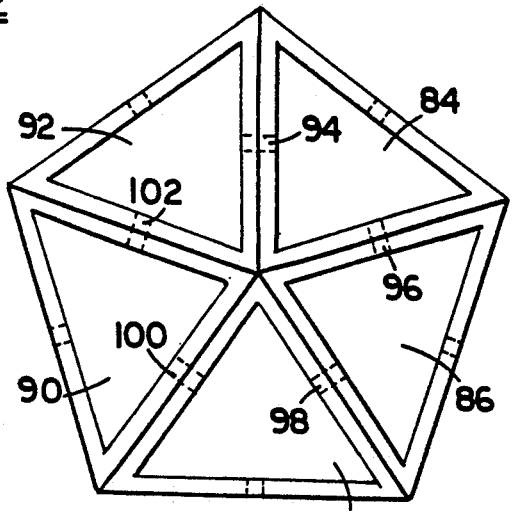
FIG. 7
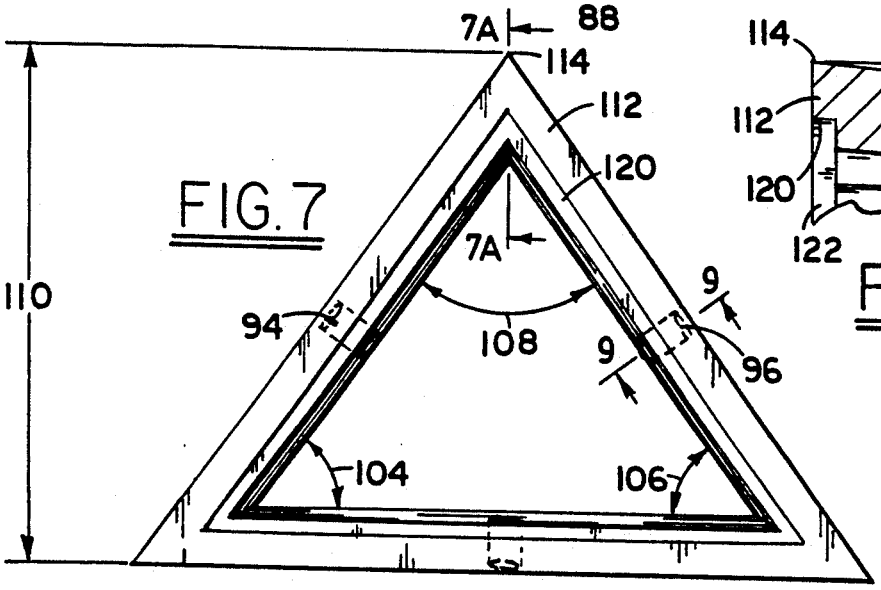
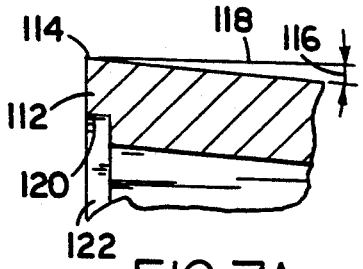
FIG. 7A
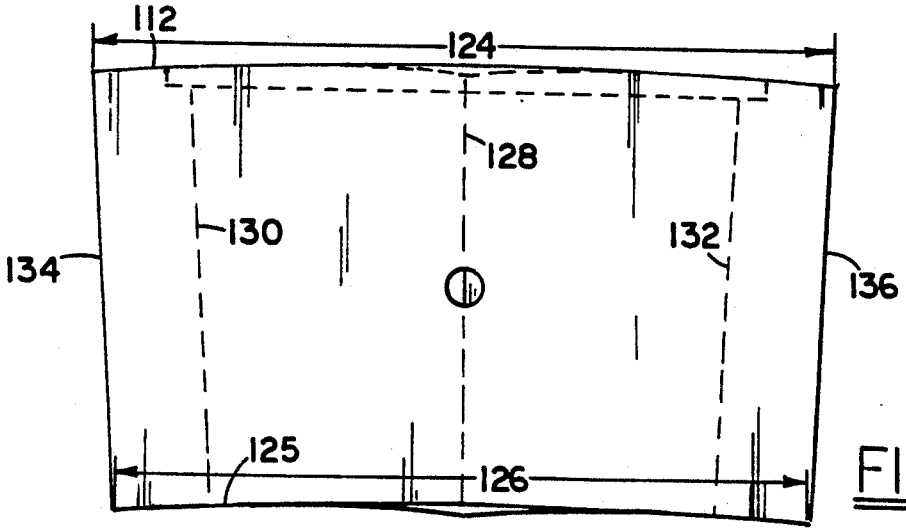
FIG. 8

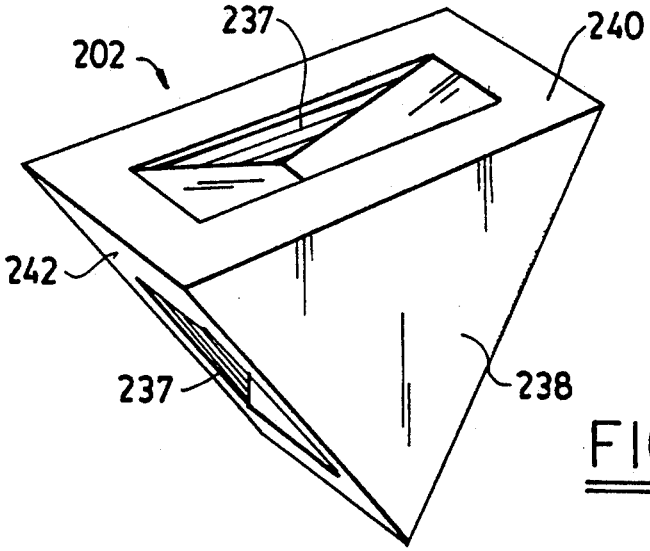
FIG. 24
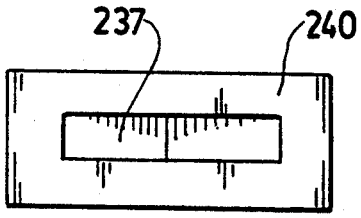
FIG. 25
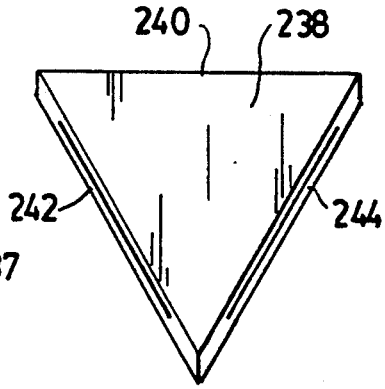
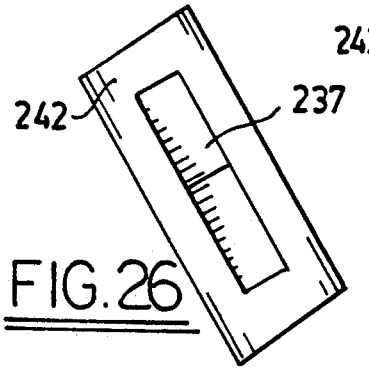
FIG. 26
FIG. 27
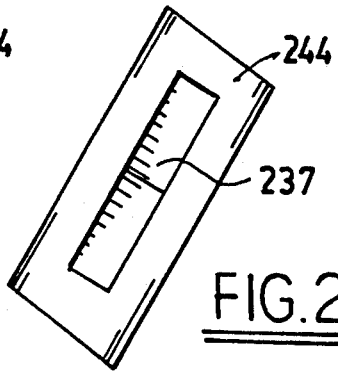
FIG. 28

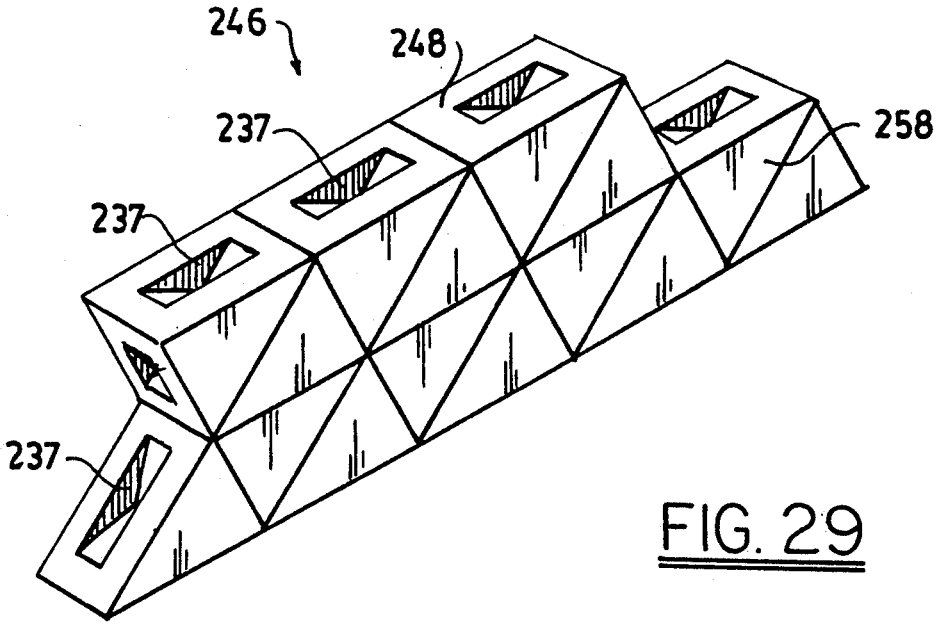
FIG. 29
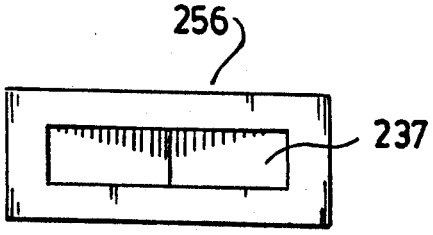
FIG. 33
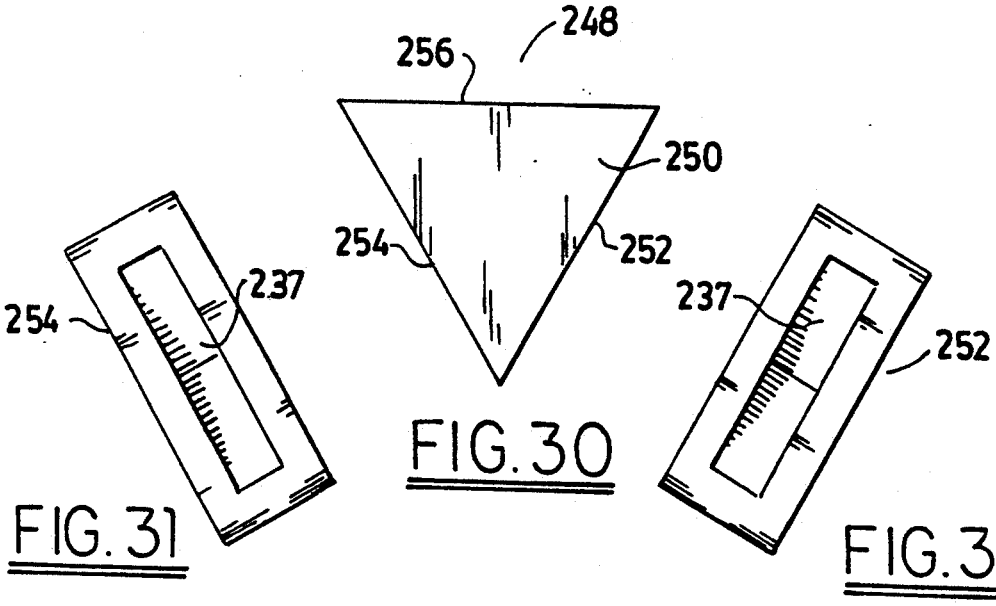
FIG. 30
FIG. 31
FIG. 32

CERAMIC BUILDING BLOCK

CROSS-REFERENCE TO RELATED PATENT APPLICATION

This is a continuation-in-part of copending patent application U.S. Ser. No. 07/739,875, filed on Aug. 2, 1991 now U.S. Pat. No. 5,261,194.

FIELD OF THE INVENTION

A building block comprised of ceramic material which is substantially triangular and which may be used to manufacture structures with curved walls.

BACKGROUND OF THE INVENTION

Arcuate structures, such as domes and cylinders, are well known to those skilled in the art and have been manufactured by various techniques.

By way of illustration, a geodesic dome is disclosed in U.S. Pat. No. 2,682,235 of Richard Buckminster Fuller, the disclosure of which is hereby incorporated by reference into this specification. The structure of this patent is a building framework of generally spherical form in which the main structural elements are interconnected in a geodesic pattern of approximately great circle arcs intersecting to form a three-way grid defining substantially equilateral triangles.

The modules which form Fuller's geodesic dome are made from light metal pieces, such as aluminum alloy (see column 5); in other Fuller patents, modules are described which contain wood, canvas, and cardboard. These modules are so arranged into the domed structure so that each module undergoes both tension and compression.

Both the modules used to make Fuller's dome and the dome itself have relatively poor compressive strength. Thus, when substantial force is exerted upon Fuller's dome from the outside of such dome, it is likely to fail. This property limits the use of Fuller's dome in applications such as, for example, underwater structures.

The durability of Fuller's dome is also somewhat limited. Because each module in the dome consists of moderately reactive material, it is likely to degrade over time.

Fuller's dome often comprises fabric (such as canvas) and/or plastic, which is used to cover the containing modules. These modules, thus, are not fireproof; and they are not suitable for use as refractory containment structures (such as kilns, e.g.). At the Montreal Exposition, a Fuller geodesic dome caught fire and was rendered uninhabitable.

Fuller's dome, furthermore, does not provide any significant resistance to radiation.

It is an object of this invention to provide a building block suitable for preparing a geodesic dome.

It is another object of this invention to provide a building block suitable for preparing a cylindrical structure.

It is yet another object of this invention to provide a building block suitable for preparing a straight wall.

It is another object of this invention to provide a building unit comprised of a multiplicity of the building blocks of this invention.

It is another object of this invention to provide a cylindrical building unit comprised of a multiplicity of the building blocks of this invention.

It is yet another object of this invention to provide a building block with improved aesthetic properties.

It is yet another object of this invention to provide a process for preparing the building block of this invention.

SUMMARY OF THE INVENTION

In accordance with this invention, there is provided a novel building block. This block has a substantially triangular shape and is comprised of at least 90 weight percent of ceramic material. The exterior faces of the building block are covered with a material which tends to blunt crack propagation.

BRIEF DESCRIPTION OF THE DRAWINGS

The present invention will be more fully understood by reference to the following detailed description thereof, when read in conjunction with the attached drawings, wherein like reference numerals refer to like elements, and wherein:

FIG. 6 is a top view of a pentagonal section of the dome of FIG. 1.

FIG. 7 is an end view of a pentagonal building block of this invention.

FIG. 7A is a side view of a corner of the block of FIG. 7.

FIG. 8 is a side view of the block of FIG. 7.

FIG. 24 is a perspective view of a second preferred building block which may be used to construct the structure of FIG. 17.

FIG. 25 is a top view of the block of FIG. 24.

FIGS. 26 and 28 are each side views of the block of FIG. 24.

FIG. 27 is a front view of the block of FIG. 24.

FIG. 29 is a perspective view of a straight wall structure of applicants' invention.

FIG. 30 is a front view of the structure of FIG. 29.

FIGS. 31 and 32 are each side views of the structure of FIG. 29.

FIG. 33 is a top view of the structure of FIG. 29.

DESCRIPTION OF THE PREFERRED EMBODIMENTS

In the first portion of this specification, applicants will describe a building block suitable for making a geodesic dome, a process for making such building block and such dome, and the geodesic dome so made. In the second portion of this specification, applicants will describe two different building blocks suitable for making a cylindrical structure.

Figure 1:
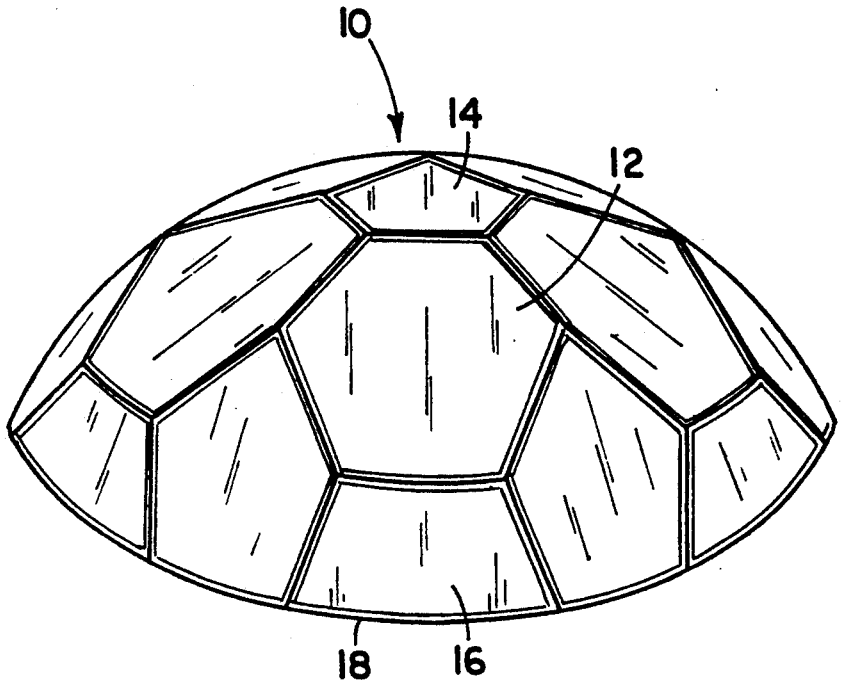
FIG. 1 is a perspective view of one embodiment of the geodesic dome of this invention.

Referring to FIG. 1, the geodesic dome 10 of this invention is shown. Prior to describing this dome, certain terms will be defined. Each of these terms is also defined, and explained, in U.S. Pat. No. 2,682,235 of Fuller, the disclosure of which is hereby incorporated by reference into this specification.

The term geodesic, as used in this specification, refers to of or pertaining to great circles of a sphere, or of arcs of such circles; as a geodesic line, hence a line which is a great circle or arc thereof; and as a geodesic pattern, hence a pattern created by the intersections of great circle lines or arcs, or their cords.

The term spherical, as used in this specification, refers to a structure having the form of a sphere. It includes bodies having the form of a portion of a sphere. It also includes polygonal bodies whose sides are so numerous that they appear to be substantially spherical.

The term icosahedron, as used in this specification, describes a polyhedron of twenty faces.

The term spherical icosahdreon refers to an icosahedron which has been "exploded" onto the surface of a sphere. It bears the same relationship to an icosahedron as a spherical triangle bears to a plane triangle. The sides of the faces of the spherical icosahedron are all geodesic lines.

The term equilateral refers to a structure in which all of the sides are approximately equal.

The term modularly divided refers to a structure which is divided into modules, or units.

Referring again to FIG. 1, it will be seen that geodesic dome 10 consists essentially of three building units. The first such unit is substantially hexagonal building unit 12. The second such unit is substantially pentagonal building unit 14. The third such unit is substantially trapezoidal building unit 16. These units are joined to each other to define a substantially spherical shape.

One or more of the sides of building units 12, 14, and 16 are curved; see, for example, side 18 of building unit 16. Thus, inasmuch as side 18 is curved, building unit 16 is substantially trapezoidal. By the same token, inasmuch as each of building units 12 and 14 have at least one curved side, they are substantially hexagonal and substantially pentagonal, respectively.

The geodesic dome illustrated in FIG. 1 is similar in some respects to the geodesic dome shown in U.S. Pat. No. 3,043,054 of Schmidt, the disclosure of which is hereby incorporated by reference into this specification. However, the geodesic dome of Schmidt includes an arcuate span of greater than 180 degrees on any vertical cross section thereof. By comparison, the geodesic dome illustrated in FIG. 1 of this specification includes an arcuate span of less than 180 degrees on any vertical cross section thereof. It is preferred that such geodesic dome include an arcuate span of less than 175 degrees on any vertical cross section thereof. In an even more preferred embodiment, such geodesic dome includes an arcuate span of less than about 171 degrees on any vertical cross section thereof.

In one preferred embodiment, geodesic dome 10 includes an arcuate span of from about 168 to about 175 degrees on any vertical cross section thereof.

Figure 2:
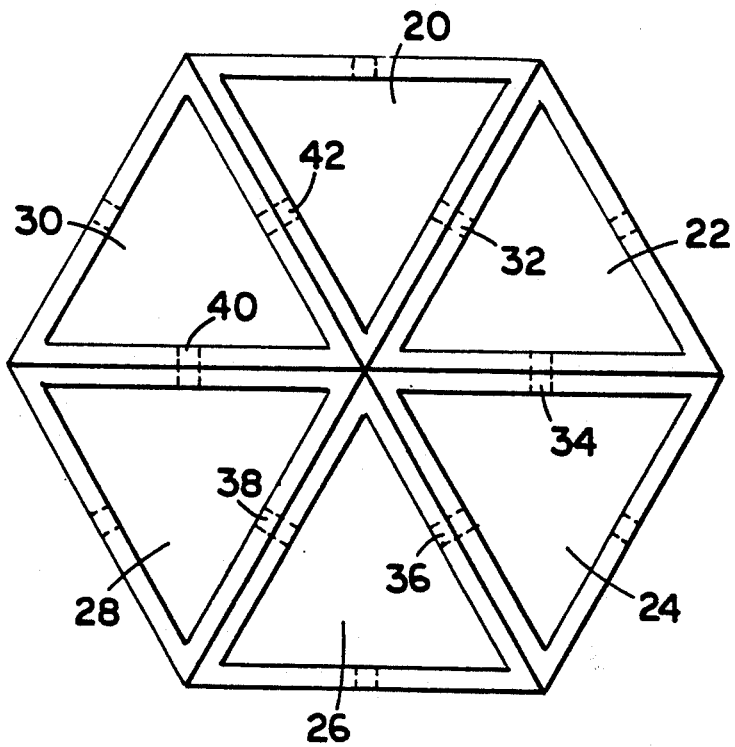
FIG. 2 is a top view of one hexagonal section of the dome of FIG. 1.

FIG. 2 is a top view of hexagonal building structure 12. Referring to FIG. 2, it will be seen that hexagonal building unit 12 is comprised of six substantially equilateral building blocks 20, 22, 24, 26, 28, and 30 which, preferably, are joined to each other by fasteners inserted through holes 32, 34, 36, 38, 40, and 42.

Each of building blocks 20, 22, 24, 26, 28, and 30 is in the shape of an equilateral triangle, and each of said blocks is substantially congruent with each of the other blocks. Thus, all of the sides of said triangle are equal. It will be apparent to those skilled in the art that any of the triangular shapes defined by said building blocks may be subdivided into smaller triangular shapes. Thus, by way of illustration, triangular building block 20 defines a triangle which might be made up of four congruous smaller triangles, and each of said four congruous smaller triangles similarly might be subdivided into four yet smaller triangles, etcetera ad infinitum.

Figure 3:
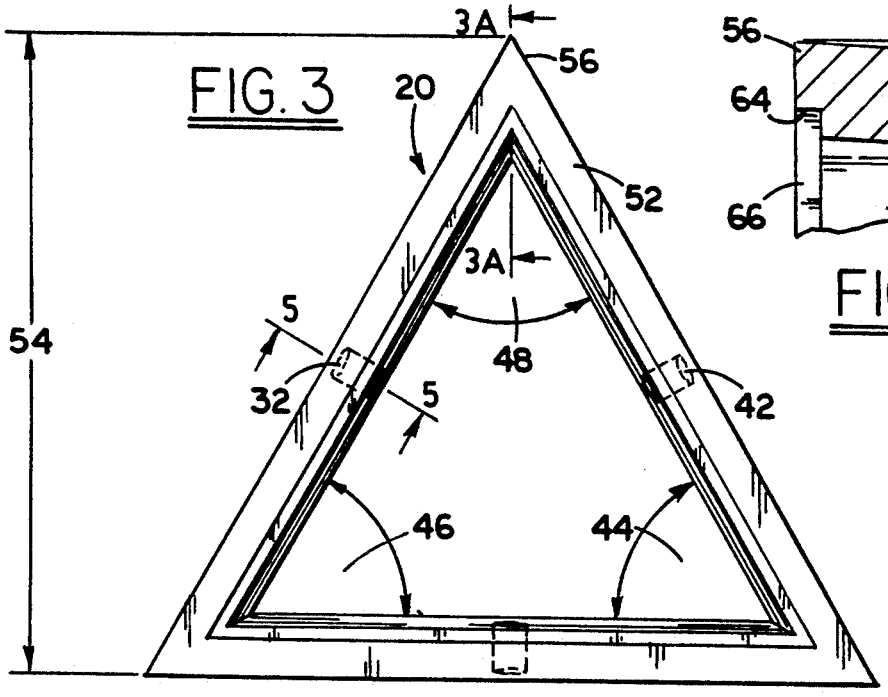
FIG. 3 is an end view of one hexagonal building block of this invention.

FIG. 3 is an end view of building block 20. Referring to FIG. 3, it will be seen that each of the angles 44, 46, and 48 are substantially 60 degrees.

Building block 20 (and each of the other building blocks 22, 24, 26, 28, and 30) are comprised of at least 90 weight percent of ceramic material. As used in this specification, the term ceramic material refers to a solid material produced from essentially inorganic, non-metallic substances which is preferably formed simultaneously or subsequently matured by the action of heat. See, e.g.. A.S.T.M. C-242-87, "Definitions of Terms Relating to Ceramic Whitewares and Related Products."

In one embodiment, the ceramic material is formed by the mixing of organic binder with a moist earth. The mass so mixed is compacted into the desired shape and used without sintering.

By way of illustration, the ceramic material used in the building block 20 may be concrete. As is known to those skilled in the art, the term concrete refers to a composite material that consists essentially of a binding medium within which are embedded particles or fragments of aggregate.

By way of further illustration, the ceramic material used in the building block 20 is a ceramic whiteware, that is a ceramic body which fires to a white or ivory color. Methods of preparing ceramic whiteware bodies are well known to those skilled in the art and are described, e.g., in U.S. Pat. No. 4,812,428 of Kohut, the description of which is hereby incorporated by reference into this specification.

In another preferred embodiment, the ceramic material is basic brick. As is known to those skilled in the art, basic brick is a refractory brick which is comprised essentially of basic materials such as lime, magnesia, chrome ore, or dead burned magnesite, which reacts chemically with acid refractories, acid slags, or acid fluxes at high temperatures.

In yet another embodiment, the ceramic material is a refractory. As is known to those skilled in the art, a refractory material is an inorganic, nonmetallic material which will withstand high-temperatures; such materials frequently are resistant to abrasion, corrosion, pressure, and rapid changes in temperature. By way of illustration, suitable refractories include alumina, sillimanite, silicon carbide, zirconium silicate, and the like.

By way of further illustration, the ceramic material may be a structural ceramic such as, e.g., silicon nitride, sialon, boron nitride, titanium bromide, etc.

In another embodiment the ceramic material consists essentially of clay or shale.

In yet another embodiment, the ceramic material consists or comprises glass. As used in this specification, the term glass refers to an inorganic product of fusion which has cooled to a rigid configuration without crystallizing. See, for example, George W. McLellan et al.'s "Glass Engineering Handbook," Third Edition (McGraw-Hill Book Company, New York, 1984). By way of illustration, some suitable glasses include sodium silicate glass, borosicliate glass, aluminosilicate glass, and the like. Many other suitable glasses will be apparent to those skilled in the art.

Figure 10:
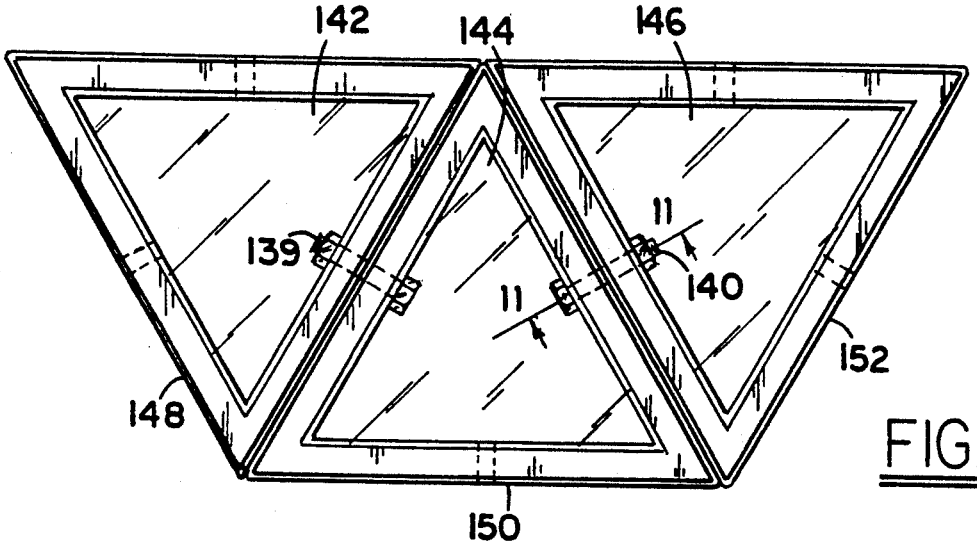
FIG. 10 is a partial top view of a geodesic dome of this invention.
Figure 11:
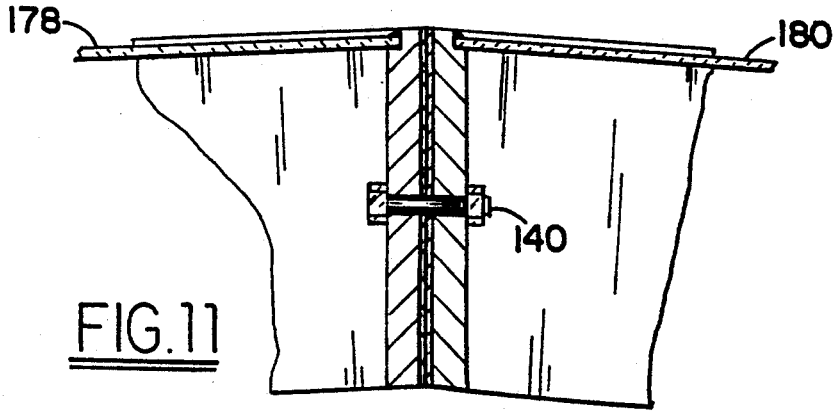
FIG. 11 is a partial sectional view of the dome of FIG. 10, taken along lines 11—11.

Referring to FIGS. 10 and 11, it will be seen that, in one embodiment, triangular window sections 142, 144, and 146 are enclosed by both the walls of the building block and by glass panes 178 and 180. In this embodiment, the building block provides insulation. The enclosed window areas 142, 144, and 146 may be comprised of air. Alternatively, or additionally, they may be comprised of inuslating material.

As will be apparent to those skillled in the art, one may use Plexiglass rather than glass. Alternatively, one may use glass which may be the same ceramic material, or a different ceramic, than is used in the body of the building block. The glass panes may be transparent, opaque, or translucent. The panes may be secured to the building block by adhesive means, a retaining pin, or any other conventional fastening means used to secure glass or plexiglass panes to window frames.

In one embodiment, glass panes 178 and 180 are comprised of plate glass.

In one embodiment, not shown, several layers of glass may be used, in a manner similar to that used on storm windows, to maximize insulating efficiency. The glass layers may be contiguous, or they may be separated by air.

In another embodiment, one may use layers of both glass and plastic material, which may be contiguous with each other.

Substantially any ceramic material may be used in applicant's building block. The use of such materials provides a block with improved resistance to radiation, resistance to heat, high compressive strength, electrical insulation, and the like. Furthermore, inasmuch as such materials may have their appearances improved by processes such as glazing, the geodesic dome 10 produced therefrom may have many desirable aesthetic features.

It is preferred that the ceramic material in building block 20 have a modulus of rupture of at least about 300 pounds per square inch. The modulus of rupture of the ceramic material is tested in accordance with A.S.T.M. Standard Test C-158-84. In one preferred embodiment, the modulus of rupture of the ceramic material is at least about 800 pounds per square inch. In another preferred embodiment, the modulus of rupture of the ceramic material is at least about 25,000 pounds per square inch.

In one preferred embodiment, the ceramic material used in building block 10 is comprised of aluminosilicate material derived from clay or shale. These aluminosilicate clay mineral materials are well known to those skilled in the art; see, e.g., the "Spinks Clay Data Book" published by the H. C. Spinks Clay Company of Paris, Tenn.

Referring again to FIG. 3, it is preferred that at least about 95 weight percent of building block 20 be comprised of ceramic material.

Building block 20 preferably is comprised of at least two orifices 32 and 42 into which fasteners (not shown) may be inserted.

Figure 3A:
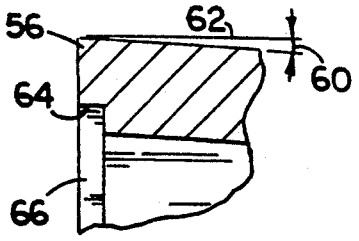
FIG. 3A is a sectional view of one corner of the building block of FIG. 3.

Applicant's building block 20 has a height 54 which decreases from its front face 52 to its rear face (not shown in FIG. 3). Thus, referring to FIG. 3A (which is a cross-sectional view of the front corner 56), it will be seen that front corner 56 is higher than the rear corner (not shown). The angle 60 formed between a line 62 drawn between the front and rear corners and a line perpendicular to the tangent of the front corner 56 is from about 1 to about 12 degrees. It will be apparent to those skilled in the art that, by varying the number and size of triangular structures in applicant's device, angle 60 may be varied. The greater the number of triangles, and the smaller their size, the smaller is angle 60.

Referring again to FIG. 3A, it will be seen that, in the preferred embodiment depicted, the front and/or rear walls of building block 20 may be recessed to receive a glass pane. Thus, notch 64 in building block 20 is adapted to receive glass pane 66. A similar notch, not shown, may appear in the rear wall(s) of building block 20. The space between the two glass panes may consist of air. Alternatively, it may be evacuated. Alternatively, it may be filled with insulating material such as, e.g., polystyrene foam.

Figure 4:
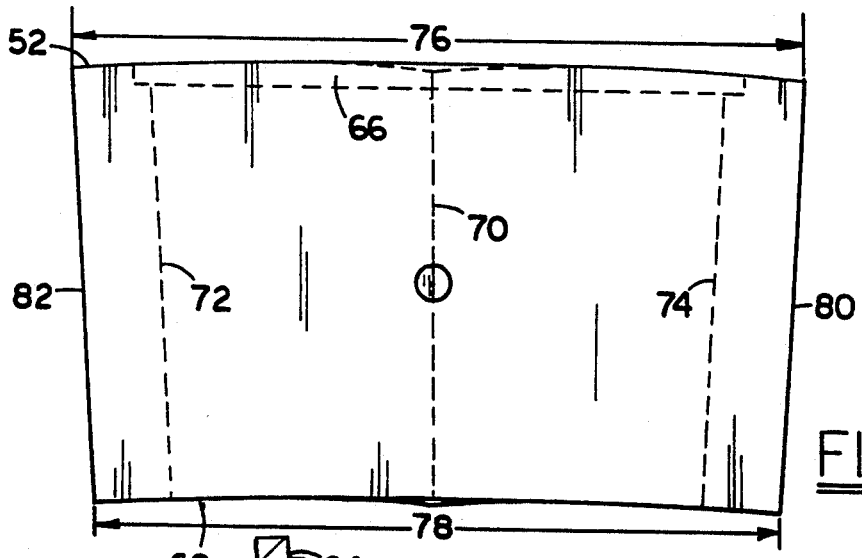
FIG. 4 is a side view of the block of FIG. 3.

FIG. 4 is a side view of the block 20 of FIG. 3. Referring to FIG. 4, it will be seen that face 52 is the front of block 20, face 68 is the rear of the block, dotted line 70 represents the top of block 20, and dotted lines 72 and 74 represent, respectively, the left and right corners of block 20.

Referring again to FIGS. 3, 3A, and 4, it will be seen that applicant's building block 20 is both wedge-shaped and beveled. In addition to height 54 decreasing from front face 52 to rear face 68 (see FIG. 4), the length 76 of face 52 is greater than the length 78 of face 68.

FIG. 4 illustrates one of the three sides of building block 20. It will be apparent to those in the art that each side of building block 20 is in the shape of a four-sided figure with two arcuate surfaces 52 and 68 of different lengths, and two straight surfaces 80 and 82 which, preferably, have substantially the same length.

Figure 5:
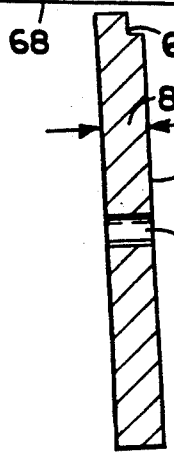
FIG. 5 is a sectional view of one side of the block of FIG. 3, taken along lines 5—5.

FIG. 5 is a sectional view of wall 80, illustrating notch 64 and orifice 42. The thickness 82 of block 20 may vary, depending upon the type of ceramic material used, its strength, and other factors well known to those skilled in the art. In general, thickness 82 will be at least about 8 percent of the length 76 of block 20.

FIG. 6 is a top view of pentagonal building structure 14. Referring to FIG. 6, it will be seen that pentagonal building unit 14 is comprised of five substantially isosceles building blocks 84, 86, 88, 90, and 92 which, preferably, are joined to each other by fasteners inserted through holes 94, 96, 98, 100, and 102.

Each of building blocks 84, 86, 88, 90, and 92 is in the shape of an isosceles triangle, and each of said blocks is substantially congruent with each of the other blocks. Thus, only two of the sides of said triangle are equal. Referring to FIG. 7, the sides of the triangle form base angles 104 and 106 of about 54 degrees and an apex angle 108 of about 72 degrees.

It will be apparent to those skilled in the art that any of the triangular shapes defined by said building blocks may be subdivided into smaller triangular shapes. Thus, by way of illustration, triangular building block 84 defines a triangle which might be made up of four congruous smaller triangles, and each of said four congruous smaller triangles similarly might be subdivided into four yet smaller triangles, etcetera ad infinitum.

Building block 84 (and each of the other building blocks 86, 88, 90, and 92) are comprised of at least 90 weight percent of the ceramic material described elsewhere in this specification. Such building block is also preferably comprised of at least two orifices 94 and 96 into which fasteners (not shown) may be inserted.

Applicant's building block 84 has a height 110 which decreases from its front face 112 to its rear face (not shown in FIG. 7). Thus, referring to FIG. 7A (which is a cross-sectional view of the front corner 114), it will be seen that front corner 114 is higher than the rear corner (not shown). The angle 116 formed between a line 118 drawn between the front and rear corners and a line perpendicular to the tangent of the front corner 114 is from about 1 to about 12 degrees. It will be apparent to those skilled in the art that, by varying the number and size of triangular structures in applicant's device, angle 60 may be varied. The greater the number of triangles, and the smaller their size, the smaller is angle 116.

Referring again to FIG. 7A, it will be seen that, in the preferred embodiment depicted, the front and/or rear walls of building block 84 may be recessed to receive a glass pane. Thus, notch 120 in building block 84 is adapted to receive glass pane 122. A similar notch, not shown, may appear in the rear wall(s) of building block 84. The space between the two glass panes may consist of air. Alternatively, it may be evacuated. Alternatively, it may be filled with insulating material such as, e.g., polystyrene foam.

FIG. 8 is a side view of the block 84 of FIG. 6. Referring to FIG. 8, it will be seen that face 112 is the front of block 84, face 125 is the rear of the block, dotted line 128 represents the top of block 84, and dotted lines 130 and 132 represent, respectively, the left and right corners of block 84.

Referring again to FIGS. 6, 7, 7A, and 8, 4, it will be seen that applicant's building block 84 is both wedge-shaped and beveled. In addition to height 110 decreasing from front face 112 to rear face 125 (see FIG. 8), the length 124 of face 112 is greater than the length 125 of face 125.

FIG. 8 illustrates one of the three sides of building block 84. It will be apparent to those in the art that each side of building block 84 is in the shape of a four-sided figure with two arcuate surfaces 112 and 125 of different lengths, and two straight surfaces 134 and 136 which, preferably, have substantially the same length.

Figure 9:
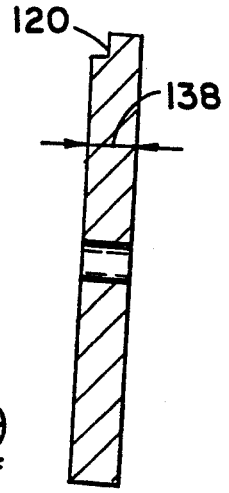
FIG. 9 is a sectional view of a wall of the block of FIG. 7, taken along lines 9—9.

FIG. 9 is a sectional view of wall 136, illustrating notch 120 and orifice 96. The thickness 138 of block 84 may vary, depending upon the type of ceramic material used, its strength, and other factors well known to those skilled in the art. In general, thickness 138 will be at least about 8 percent of the length 124 of block 84.

FIG. 10 is a sectional view of a portion of building section 12, illustrating how building blocks 24, 26, and 28 may be joined to each other. Referring to FIG. 10, it will be seen that fasteners 139 and 140 may be inserted through orifices 36 and 38 (not shown in FIG. 2) to join the blocks together.

In the embodiment illustrated in FIG. 2, the fasteners used are nuts and bolts. In another embodiment, not shown, the fastener used is one which will not extend into the triangular window sections 142, 144, and 146 defined by the building blocks. By way of illustration and not limitation, one such suitable fastener is a clevis pin. Alternatively, or additionally, one may use adhesive, a shim, and the like.

Figure 12:
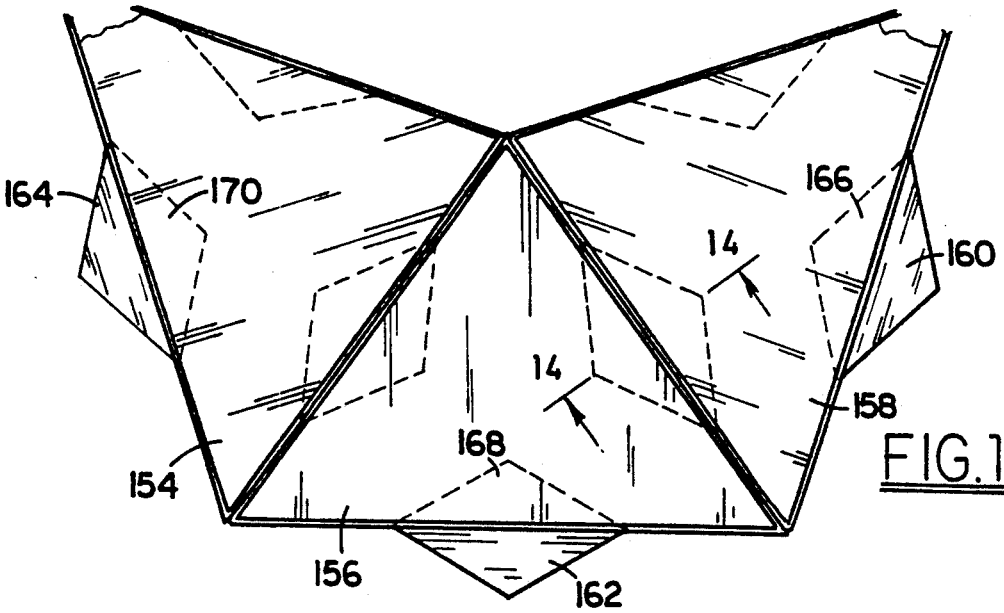
FIG. 12 is a sectional view of three of the building blocks of FIG. 1 joined together.

In the preferred embodiments illustrated in FIGS. 10 and 12, each of the building blocks (such as building blocks 24, 26, and 28) is preferably sheathed in a gasket material. Thus, gasket material 148 sheaths the outer faces of building block 28, whereas gasket materials 150 and 152 sheath building blocks 26 and 24, respectively.

In this embodiment, the gasket material tends to prevent crack propagation when the building block is subjected to a severe shock. Any of the materials known to inhibit crack propagation of ceramic material may be used as the gasket material. Thus, by way of illustration, one may use rubber, an elastomer, red rubber, silicone, tan vegetable fiber, neoprene, fiberfax, fiberglass, polyvinylchloride, latex, soft metal, and the like.

In general, the thickness of the gasket material will range from about 0.016 to about 1.0 inches. The thickness of the gasket material will generally be from 0.05 to about 10 percent of the thickness of the wall of the building block.

The gasket material, although it may be either organic or inorganic, will preferably have a different chemical composition and a different Young's modulus than the ceramic material in the building block.

In the embodiment illustrated in FIGS. 10 and 11, it is preferred that gasket material contact the entire surface of each of the adjacent faces so that there is substantially no direct contact between the ceramic surfaces of adjacent blocks.

In the preferred embodiment illustrated in FIG. 11, fastener 140 is also sheathed by a gasket material similar to that described above so that there is preferably no direct contact between fastener 140 and the ceramic material of the building block.

FIG. 12 illustrates another means of joining adjacent building blocks. In the preferred embodiment illustrated in this Figure, each of building blocks 154, 156, and 158 is substantially solid. Each face of these substantially solid building blocks is comprised of a substantially triangular orifice; when two of such orifices are placed base to base, they define a substantially diamond-shaped figure.

Referring again to FIG. 12, it can be seen that diamond shaped plug 160, 162, and 164 may be placed into the triangular orifices, such as orifices 166, 168, and 170. Once these plugs have been placed into the orifice, the blocks may be joined to adjacent blocks by lining up the diamond-shaped plug so that if fits into the orifice of the adjacent block. In this embodiment, in addition to joining adjacent blocks together, the diamond-shaped plugs also help to align them.

Figure 13:
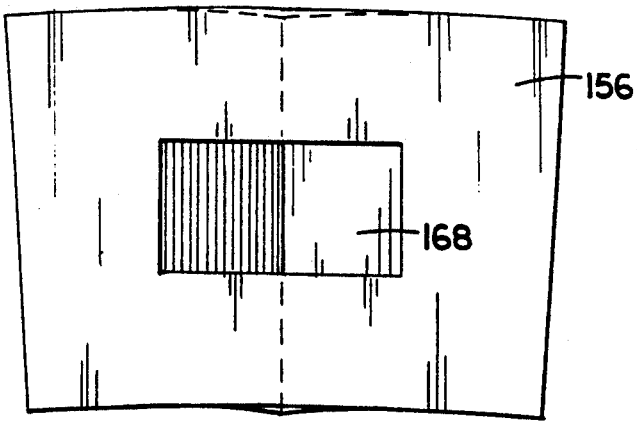
FIG. 13 is a side view of the structure of FIG. 12.
Figure 14:
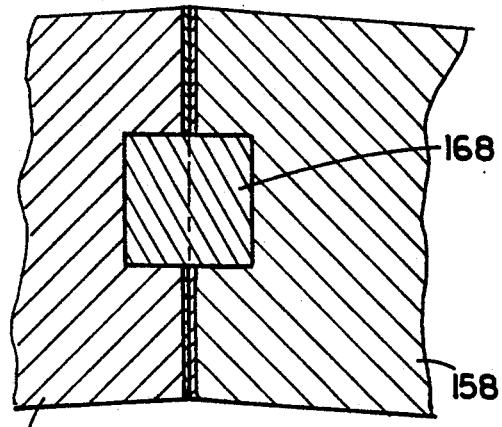
FIG. 14 is a sectional view, taken along lines 14—14 of FIG. 12, of the juncture of two of said building blocks.

FIG. 13 is a side view of block 156, showing substantially triangular shaped orifice 168. FIG. 14 is a cross-section taken across lines 14—14 between adjacent blocks 156 and 158.

Figure 15:
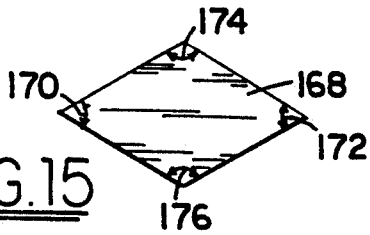
FIG. 15 is a top view of a wedge used to join the building blocks in FIG. 12.

FIG. 15 illustrates the shape of the preferred plug 168 which may be used in the embodiment of FIG. 12. In this embodiment, it is preferred that plug 168 define a four-sided Figure containing two substantially acute angles 171 and 172 of about 60 degrees and two substantially obtuse angles 174 and 176 of about 120 degrees.

Figure 16:
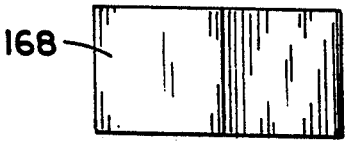
FIG. 16 is a side view of the wedge of FIG. 15.

FIG. 16 is a side view of plug 168.

PROCESS FOR PREPARING BUILDING BLOCKS 20 AND 84

Building blocks 20 and 84, and other similarly shaped blocks, may be made by convention ceramic forming processes. Thus, for example, one may use the processes described in, e.g., James S. Reed's "Introduction to the Principles of Ceramic Processing," (John Wiley & Sons, New York, 1988). Thus, one may use pressing (see pages 329–353), plastic forming (see pages 255–379), casting (see pages 380–402), and the like.

In one preferred embodiment, the building block 20 and/or 84 is made by ram-pressing. As is known to those skilled in the art, ram pressing is a process for plastic forming of ceramic ware by pressing a bat of the prepared body between two porous plates or mold units; after the pressing operation, air may be blown through the porous mold parts to release the shaped ware. See, e.g., A. E. Dodd's "Dictionary of Ceramics, Potter, Glass...," Philosophical Library, Inc., New York, 1964).

In one embodiment, the building block is made with a CINVA-Ram block press using a mixture of soil, sand, silt, clay, and cement; the press has a mold box in which a hand-operated piston compresses a slightly moistened mixture of soil and cement or lime. This process is described in, e.g., a publication entitled "Making Building Blocks with the CINVA-Ram Block Press" (Volunteers in Technical Assistance, Mt. Ranier, Md., 1977). After the green body is formed by this process, it may be sintered.

In another embodiment, the building block is made by slip casting in a plaster mold, and the green body thus formed is sintered by conventional means.

In one preferred embodiment, the building block 20 and/or the building block 84 has a porosity of at least about 20 volume percent. Any conventional means may be used to produce a ceramic article with this porosity. Thus, by way of illustration, one may prepare a green body which contains at least about 1 weight percent of pore-forming body which, upon sintering, will burn out of the ceramic. Thus, one may use micro-balloons, sawdust, shredded rubber, and any other organic material which will burn out during sintering and create the desired pore structure.

One advantage of applicant's building block is that it may be produced in many different locations from commonly available materials. Thus, anywhere where clay and sand is available, one may shape the building block, sinter it with a solar kiln, and build one's desired structure. If, for example, one were on the moon (where the solar wind is quite strong and clay is readily available), one can produce a ceramic building from commonly available material.

PREPARATION OF BUILDING SECTIONS 12, 14, AND 16

As indicated above, and referring to FIG. 1, hexagonal building section 12 may be produced by joining together six of the triangular building blocks 20 (see FIG. 10). Pentagonal building section 14 may be produced by joining together five of the triangular building blocks 84 (see FIG. 6). Substantially trapezoidal building unit 16 may be produced by joining together three of the triangular building blocks 20.

CONSTRUCTION OF GEODESIC DOME 10

Referring to FIG. 1, a geodesic dome 10 may be constructed by placing a pentagonal building unit 14 at its apex, by surrounding said building unit 14 with five building unit's 12 and joining them thereto to form a second layer of structure; by joining five pentagonal building units 14 to the bases of the hexagonal building units 12 to form a partial third layer of structure; by inserting six hexagonal building units 12, into the interstices formed between the second layer of building units 12 and the third layer of building units 14 and joining said units; and by thereafter repeating the process until the desired domed shape is formed.

In another embodiment, the dome 10 may be built from the ground up instead of from the top down. In this latter embodiment, a scaffold is not needed to produce dome 10 inasmuch as each layer of structure is supported by the prior layer of structure and by the fasteners used to secure the building blocks together.

When one has produced a geodesic dome with the desired degree of curvature, one may place building units 16 into the interstices formed by the penultimate layer of building units 12 and the last layer of building units 14. Thereafter, one may join the last layer of structure, which now consists of alternating units 14 and 16, to a base (not shown).

Any conventional means may be used to join the dome 10 to the base. In one embodiment, not shown, the base (not shown) is provided with metal brackets containing an orifice, and a fastener is inserted through this orifice and the appropriate orifice of the building unit(s). One may sheath the fastener used in this embodiment so that it does not contact the ceramic material.

It will be apparent to those skilled in the art that, if one or more of building blocks 20 and/or 84 break, they may be detached from their adjacent building blocks by removing the fastener(s) therebetween, a new building block may then be inserted in place of the broken block(s), and the new building block(s) may then be fastened to the adjacent blocks. This feature permits the relatively inexpensive repair of a wall comprising said building blocks.

A GEODESIC DOME FOR UNDERWATER USE

In one preferred embodiment, not shown, an underwater domed structure is provided. Because of the great compressive strength of such a structure, one need not provide an atmosphere at a pressure of substantially greater than 760 millimeters of mercury within the domed structure.

The underwater domed structure of this embodiment may be provided by the means described above, with one exception: one preferably continues the construction of dome 12 until the dome includes an arcuate span of from about 170 to about 360 degrees.

In one embodiment of this invention, a geodesic dome 10 may be used to store radioactive waste. Because dome 10 is comprised of ceramic material which is substantially inert, and which tends to block the propagation of radioactive emissions, it is especially suitable for this purpose.

In one embodiment, not shown, a hexagonally-shaped ceramic structure comprised of at least 90 weight percent of ceramic material is provided. This structure may contain a hollow center; alternatively, it may be a solid structure. In this embodiment, the hexagonally-shaped structure may be used to construct a relatively small structure such as, e.g., a small kiln.

In yet another embodiment, not shown, a pentagonally-shaped structure containing at least 90 weight percent of ceramic material, which may be either hollow or solid, is provided.

In one embodiment of the invention, a process for preparing a ram-pressed green body is provided. In the first step of this embodiment, there is provided a mold comprised of a semi-permeable air hose which, because of the force of air flow, facilitates the separation of the molded body from the mold surface. In the second step of the process, high-strength industrial plaster material (such as "CERAMICAL", which is sold by United States Gypsum Company) is puored into the mold. In the third step of the process, once the plaster material has begun to set, the semi-permeable air hose is purged with compressed air which is drawn by a vacuum directly to the mold surface; the vacuum is directed to specified portions of the mold surface by holes selectively placed in the mold surface.

A CYLINDRICAL BUILDING STRUTURE

Figure 17:
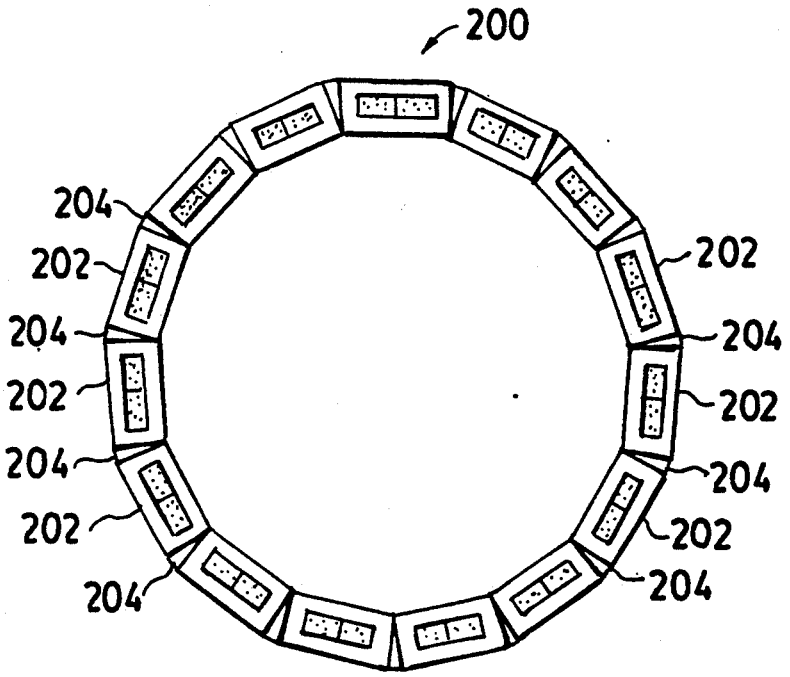
FIG. 17 is a top view of one preferred cylindrical structure of this invention.

FIG. 17 is a top view of a cylindrical structure 200 which is comprised of a multiplicity of building blocks 202 each of which is adjacent to a building block 204. These blocks may be manufactured in accordance with the procedures described in the first portion of this specification.

As will be apparent to those skilled in the art, the structure of FIG. 17 may be used not only to construct a cylinder but any portion of a cylinder. Thus, e.g., one may construct a portion of an arch with such a configuration.

In one preferred embodiment, fifteen blocks 202 (or an integral multiple of fifteen such blocks) are used in each layer 206 (see FIG. 18) of cylindrical structure 200. In such preferred embodiment, fifteen blocks 204 (or an integral multiple of fifteen such blocks) are also used in each layer 206. It will be apparent to those skilled in the art that an equal number of blocks 202 and blocks 204 are preferably used in each such layer 206.

As will be illustrated later in this specification, blocks 202 may be connected to blocks 204 by means of plugs 168 (see FIG. 15).

Figure 18:
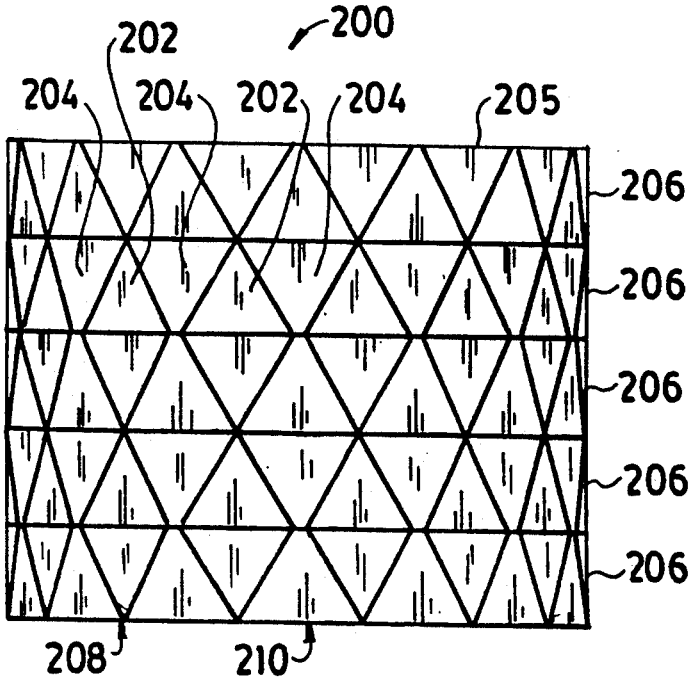
FIG. 18 is a side view of the structure of FIG. 17.

FIG. 18 is a side view of the structure of FIG. 17. It will be seen that, in any one layer 206 (such as, e.g., the second layer from top 205 of structure 200), each block 202 is adjacent to two blocks 204, and each block 204 is adjacent to two blocks 202. However, in the vertical direction (see course 208) one layer of blocks 202 are vertically stacked so that two blocks 202 are joined base to base, and the next two blocks 202 are joined tip to tip, and the next two blocks 202 are joined base to base, etc. Similarly, in the vertical direction (see course 210), two blocks 204 are stacked tip to tip, and the next two blocks 204 are stacked base to base, and the next two blocks 204 are stacked tip to tip, etc. The blocks 202 and 204 may be joined to each other by the means described elsewhere in this specification.

Figure 19:
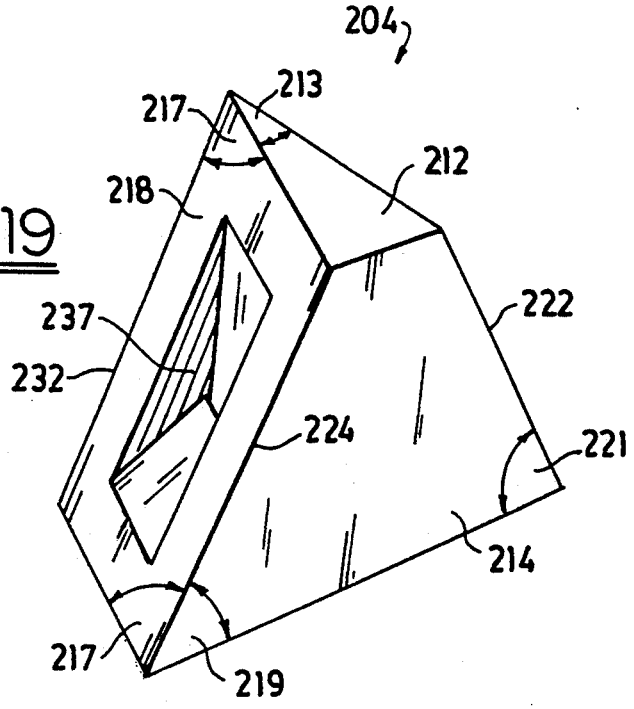
FIG. 19 is a perspective view of a first preferred building block which may be used to construct the structure of FIG. 17.

FIG. 19 is a perspective view of building block 204. Building block 204, like building block 20 and building block 84 and building block 202, is preferably comprised of at least 90 weight percent of ceramic material, which material is discussed and described elsewhere in this specification.

In one preferred embodiment, building block 204 and/or 20 and/or 84 and/or 202 consists essentially of plastic material. As is known to those skilled in the art, a plastic is a material that contains as an essential ingredient an organic substance of large molecular weight, is solid in its finished state, and, at some stage in its manufacture or in its processing into finished articles, can be shaped by flow. See A.S.T.M. Standards D 1695, D-23, C 582, and C-3. Also see the "Modern Plastics Encyclopedia '92" (the mid-October 1991 issue of Modern Plastics, Volume 68, Number 11). Thus, e.g., one or more of such blocks may consist essentially of such plastics as polystyrene, polyvinyl chloride, high density polyethylene, nylon, and the like.

In another embodiment, not shown, one or more of such blocks may consist essentially of a plastic/ceramic composite material.

In one embodiment, not shown, block 204 can be constructed with window sections similar to window sections 142, 144, and 146 (see FIGS. 10 and 11).

Figure 20:
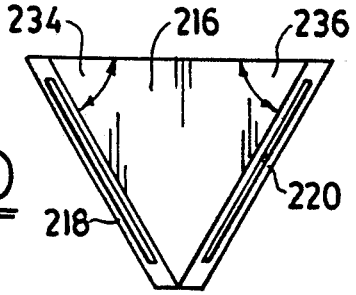
FIG. 20 is a back view of the block of FIG. 19.

Referring again to FIG. 19, it will be seen that block 204 is preferably comprised of at least six sides, including top side 212, front side 214, back side 216 (not shown in FIG. 19, but see FIG. 20), left side 218, and right side 220 (not shown in FIG. 19, but see FIG. 20).

Top side 212 is the truncated tip of beveled sides 218 and 220 and has a substantially triangular cross-sectional shape. It is preferred that top side 212 have a cross-sectional shape which is an isosceles triangle.

Front side 214 is in the shape of a trapezoid, which is comprised of two equal edges 222 and 224 (see FIG. 19).

Rear side 216 is in the form of a triangle (see FIG. 20) which may be, but need not be, in the form of an equilateral triangle.

Figure 23:
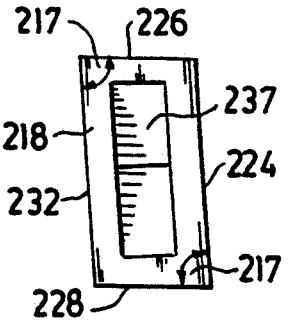
FIG. 23 is a side view of the block of FIG. 19.

Left side 218 and right side 220 are in the form of parallelograms. Thus, referring to FIG. 23, top edge 226 is parallel to bottom edge 228, and right edge 224 is parallel to left edge 232.

The apex of side 212 is formed by an acute angle 213 which, preferably is equal to or substantially equal to 360 degrees divided by the number of blocks 204 in any particular layer 206. Thus, e.g., if there are 15 such blocks in layer 206, angle 213 will be about 24 degrees. If there are 30 such blocks in layer 206, angle 213 will be 12 degrees. In general, it is preferred that angle 213 be from about 4 to about 24 degrees.

Referring again to FIG. 19, and the trapezoid defined by side 214, it is preferred that angle 219 be equal to angle 221 and that each of angles 219 and 221 be from about 30 to about 70 degrees.

Referring again to FIGS. 19 and 23, the angle 217 in the parallelogram defined by side 218 is less than ninety degrees and, preferably, will be from about 86 to about 89.5 degrees.

It is preferred that the precise angle 217 be equal to $90-x$, wherein x is equal to $(90-y/90)\cdot z$, wherein y is the number of degrees in angle 219 (or angle 221), and wherein z is equal to one half of the number of degrees in angle 213.

It will be appreciated by those skilled in the art that right side 220 will be congruent with left side 218 and, thus, will also contain two angles 217. Furthermore, referring to FIG. 20 and the side 216 depicted therein, it will be seen that angles 234 and 236 are equal to each other and also equal to angles 219 or 221.

Figure 21:
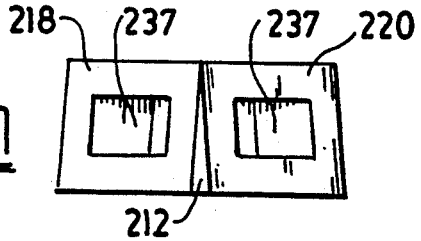
FIG. 21 is a top view of the block of FIG. 19.
Figure 22:
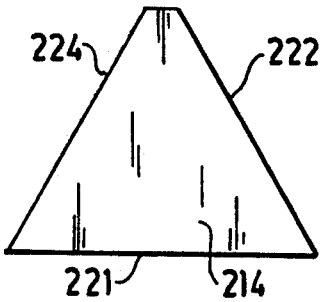
FIG. 22 is a front view of the block of FIG. 19.

FIG. 21 is top view of block 204. FIG. 22 is a front view of block 204.

Referring to FIGS. 19, 20, 21, and 23, it will be seen that, in the preferred embodiment illustrated in these Figures, a means is provided for connecting block 204 with an adjacent block 202. This means is similar to the means described elsewhere in this specification for joining adjacent building blocks 154, 156, and 158. In this embodiment, each of block 202 and block 204 of these substantially solid building blocks is preferably comprised of a substantially triangular orifice; when two of such orifices are placed base to base, they define a substantially diamond-shaped figure (see FIG. 12).

Referring again to FIG. 12, it can be seen that diamond shaped plug 160, 162, and 164 may be placed into the triangular orifices, such as orifices 166, 168, and 170. In a similar manner, and referring to FIGS. 19, 21, and 23, such a plug may be placed into orifice 237.

As will be apparent to those skilled in the art, block 224, in addition to containing such substantially triangular shaped orifice 237 on sides 218, on side 220, and on bottom side 221 (see FIG. 22).

In the preferred embodiment illustrated in FIGS. 19 through 22, the preferred plug used to connect block 204 with block 202 is substantially identical to the plug 168 which is illustrated in FIG. 15 and is discussed elsewhere in this specification.

FIG. 15 illustrates the shape of the preferred plug 168 which may be used in the embodiment of FIG. 12. In this embodiment, it is preferred that plug 168 define a four-sided Figure containing two substantially acute angles 171 and 172 of about 60 degrees and two substantially obtuse angles 174 and 176 of about 120 degrees.

FIG. 24 is a perspective view of a second block, block 202, which also is used in the structure 200 of FIG. 17. As will be seen from FIG. 24, block 202 also contains orifice 237 on each of sides 240, 242, and 244.

Referring to FIGS. 24 and 25, it will be seen that side 240 has a substantially rectangular shape. However, each of sides 242 and 244 are in the shape of a parallelogram with the same size and shape as the parallelogram defined by sides 218 and 220 of block 204 (see FIGS. 19 through 22).

Side 238 is in the shape of an isosceles triangle and is congruent to the isosceles triangle defined by side 216 of block 24 (see FIG. 20).

The triangle on the opposing side of side 238 (not shown in these Figures) is congruent to the triangle defined by side 238.

The building block 202 may be constructed in the same or similar manner, and contain the same or similar materials, as the building block 204.

A STRAIGHT WALL STRUCTURE

FIG. 29 illustrates a substantially straight wall structure which is comprised of a multiplicity of substantially triangular building blocks 248. Referring to FIG. 30, which is a front view of block 248, it will be seen that the front face 250 of block 248 (and its back face, not shown, which is congruent to front face 250) is an isosceles triangle with sides 252 and 254 being equal. In one especially preferred embodiment, each of sides 252, 254, and 256 of block 248 are equal.

FIG. 31 is a front view of face 254. FIG. 32 is a front view of face 252. FIG. 33 is a front view of face 256. In the preferred embodiment illustrated in these Figures, each of face 252, 254, and 256 is in the shape of a rectangle.

Referring again to FIG. 29, two of building blocks 248 may be stacked to form a straight walled structre (which may be in the form of a parallelogram) 258. When a multiplicity of parallelograms 258 are placed in abutting connection (as, e.g., by means of plugs 168), the substantially straight walled structure of FIG. 29 is produced.

Figure 37:
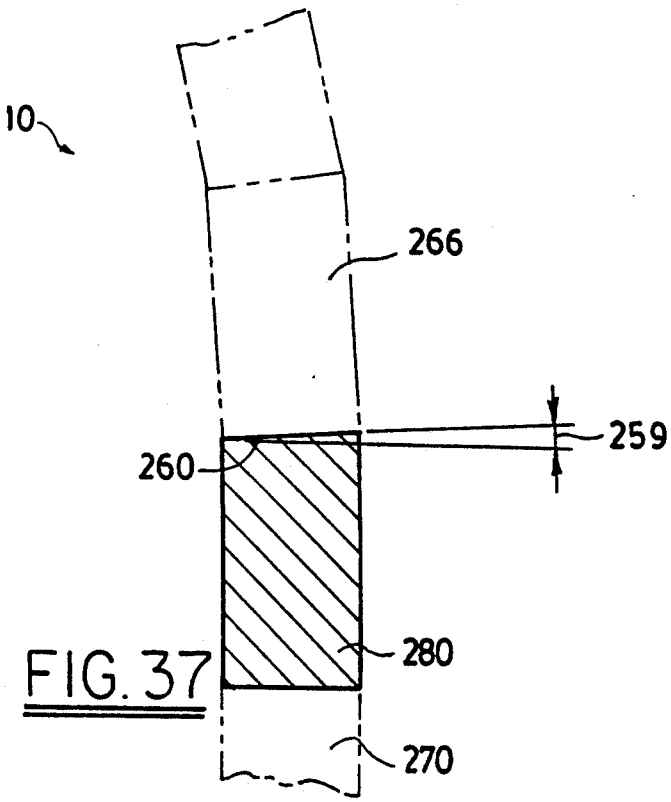
FIG. 37 is sectional view of the structure of FIG. 34.

When a geodesic dome 10 is produced in accordance with the procedure of this invention (see FIG. 1), the bottom surface of such dome will not be normal to the horizon. Referring to FIG. 37, it will be seen that geodesic dome 10 (only a portion of which is shown for the sake of simplicity) will form an angle 259 (often referred to as a bevel angle) with a flat surface 260 on which it is placed. Thus, as is disclosed elsewhere in this specification, the geodesic dome includes an arcuate span of less than 174 degrees on any vertical cross section thereof; consequently, angle 259 is at least 3 degrees.

The need for some means to stabilize the juncture of the geodesic dome and another structure is illustrated in FIGS. 34 through 37.

Figure 34:
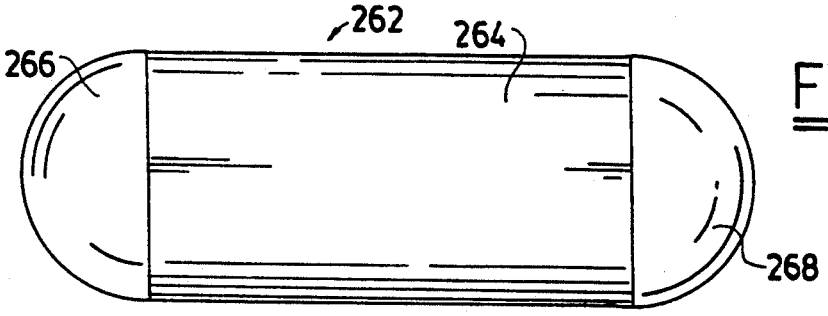
FIG. 34 is a top view of another preferred structure of applicants' invention.

FIG. 34 is a top view of one preferred building structure which is comprised of an arched section formed by half a cylinder 264 (which may be constructed by blocks 202 and 204), a first half of a geodesic dome 266 (which may be constructed by blocks 20 and 84), and a second half of a geodesic dome 268 (which also may be formed by blocks 20 and 84).

Figure 35:
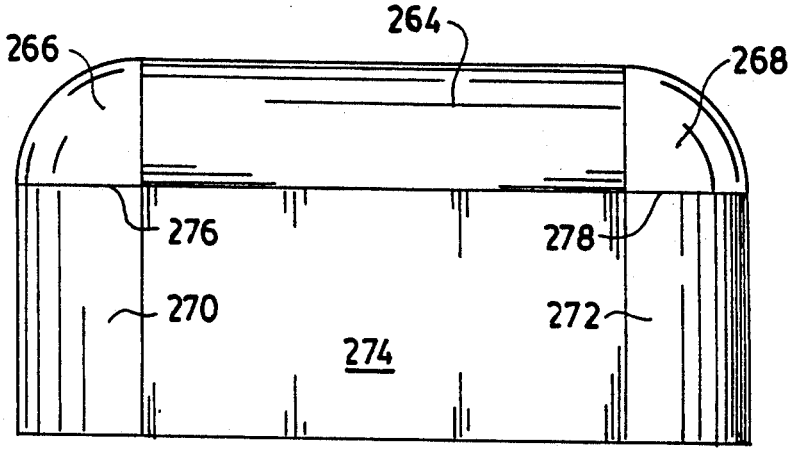
FIG. 35 is a side view of the structure of FIG. 34.
Figure 36:
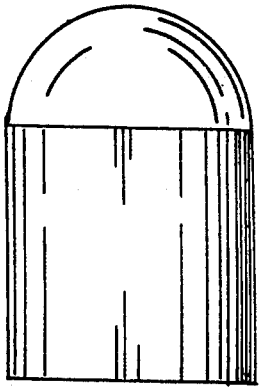
FIG. 36 is an end view of the structure of FIG. 34.

FIG. 35 is a side view of the structure 262 of FIG. 34. Referring to FIG. 35, it will be seen that structure 262 also is comprised of substantially cylindrical sections (half a cylinder) 270 and 272, each of which may be constructed from blocks 202 and 204. Furthermore, structure 262 also is comprised of substantially straight walled structure 274, which may be constructed from blocks 248.

Referring again to FIG. 35, the junctures 276 and 278 where sections 266 and 268 abut sections 270 and 272 produce an abutment which is substantially less than perfect. This abutment is illustrated in FIG. 37.

Referring to FIG. 37, it will be seen that a juncture ring 280 has been placed between section 266 and section 270 to compensate for the bevel 259 caused by section 266. In a similar manner, a similar junction ring may be placed at the junction 278 between section 268 and section 272. A preferred embodiment of this juncture ring is illustrated in FIGS. 38 through 42.

Figure 38:
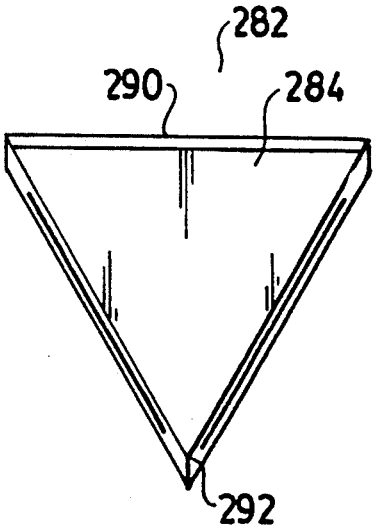
FIG. 38 is a front view of one of the blocks used in the structure of FIG. 34.

FIG. 38 is a perspective view of a first juncture ring block 282 which has a front face 284 which is substantially triangular in cross section. It is preferred that the front face 284 form a substantially isosceles triangle and, in one especially preferred embodiment, form a substantially equilateral triangle.

Figure 39:
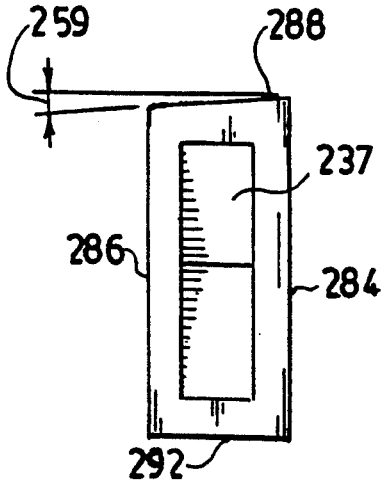
FIG. 39 is a side view of the block of FIG. 38.

FIG. 39 is a side view of the juncture ring block 282 of FIG. 38. It will be seen that, in the embodiment depicted, back face 286 (not shown in FIG. 38, but shown in FIG. 39) will have a height which is less than the height of front face 284. Thus, a bevel will form an angle 259 (see FIGS. 39 and 37).

It will be apparent to those skilled in the art that the juncture ring block 282 of FIGS. 38 and 39 will decrease in width from point 290 to point 292. By comparison, the juncture ring block 294 of FIGS. 40 through 42 will also decreases in width from point 296 to point 298.

Figure 40:
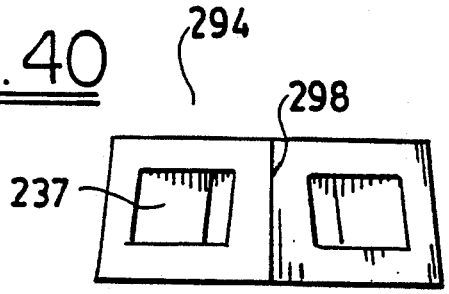
FIG. 40 is a top view of a section of the structure of FIG. 34.
Figure 41:
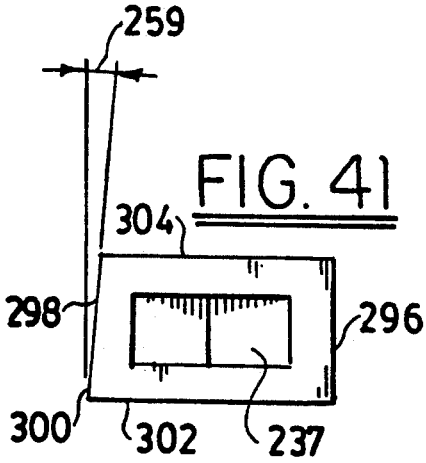
FIG. 41 is an side view of the structure of FIG. 40.
Figure 42:
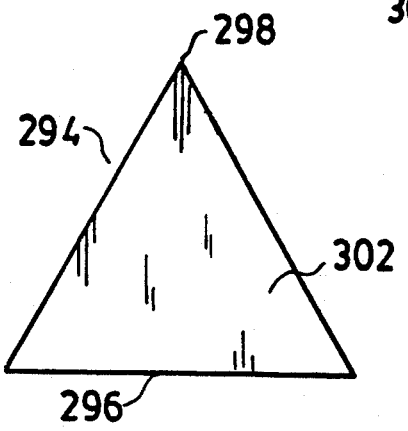
FIG. 42 is a front view of the structure of FIG. 40.

FIG. 40 is a top view of juncture ring block 294 illustrating apex 298. FIG. 41 illustrates that apex 298 has a bevel 300 from outer face 302 to the inner face 304 (see FIG. 41) of angle 259.

As will be apparent to those skilled in the art, block 282 may be placed on the top of section 270 (see FIG. 37), and block 294 may be placed adjacent to block 282. A ring structure similar to the one depicted in FIG. 17 may be formed from such alternating blocks 282 and 294 and form the ring juncture.

In one embodiment, not shown, one or more of the building blocks of this invention is joined by means of a plug 168 in which one or more of the apexes of triangular halves of the plug are rounded off.

In one embodiment, not shown, one or more of the building blocks of this invention is connected to one or more adjacent blocks by means of an expandable plug disposed within orifice 237 which, in whole or part, can replace static plug 168. Alternatively, one may have a multiplicity of expandable pins per face. In one embodiment, at least one face of the building block will have neither such a pin/plug assembly or an orifice 237.

In one embodiment, instead of being constructed from either ceramic material or plastic material, one or more of the building blocks of this invention consists essentially of a metal material, such as aluminum, steel, iron, and the like.

In one embodiment, the plug 168 is so constructed that an elastomeric gasket material extends from the middle plane of the plug. In this embodiment, when the plug is used to connect two adjacent building blocks, the juncture of such blocks is separated by the elastomeric gasket material.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

We claim:

1. An arcuate building structure comprised of a first five-sided building block adjacent to and abutting a first six-sided building block adjacent to and abutting a second five-sided building block adjacent to and abutting a second six-sided building block adjacent to and abutting a third five-sided building block adjacent to and abutting a third six-sided building block, wherein:

(a) each of said first five-sided building block, said second five-sided building block, and said third five-sided building block has substantially the same shape and size;

(b) each of said first six-sided building block, said second six-sided building block, and said third six-sided building block has substantially the same shape and size;

(c) each of said first six-sided building block, said second six-sided building block, and said third six-sided building block is comprised of a first top side, a first front side, a first back side, a first left side, a first right side, and a first bottom side, wherein:

1. said first top side has a substantially triangular shape, wherein at least two of the sides of such triangular shape are equal, and said first top side is substantially parallel to said first bottom side,
2. said first front side has a substantially trapezoidal shape comprising a top edge, a bottom edge, a right edge, and a left edge, wherein said right edge and said left edge have equal lengths and form equal angles with said bottom edge,
3. said first back side has a substantially triangular shape with at least two sides equal in length to each other,
4. said first left side and said first right side have shapes which are congruent, and each of said first left side and said first right side are in the shape of a parallelogram and comprise a substantially triangular-shaped recess disposed between the walls of said parallelogram, and
5. said first bottom side has a substantially trapezoidal shape and is comprised of a substantially triangular recess disposed between the walls of such trapezoidal shape;

(d) each of said first five-sided building block, said second five-sided building block, and said third five-sided building block is comprised of a second top side, a second front side, a second back side, a second right side, and second left side, wherein:

1. said second top side has a substantially rectangular shape and comprises a substantially triangularly shaped recess disposed within said substantially rectangular shape,
2. said second left side and said second right side are congruent with each other and are also congruent with said first left side and said first right side,
3. said second front side is congruent with both said second back side and said first back side; and (e) disposed within each of said triangular recesses is a means for connecting one of said five-sided building blocks with one of said six-sided building blocks.

2. The arcuate building structure as recited in claim 1, wherein each of said first five-sided building block, said first six-sided building block, said second five-sided building block, said second six-sided building block, said third five-sided building block, and said third six-sided building block consists essentially of ceramic material.

3. The arcuate building structure as recited in claim 1, wherein each of said first five-sided building block, said first six-sided building block, said second five-sided building block, said second six-sided building block, said third five-sided building block, and said third six-sided building block consists essentially of plastic material.

4. The arcuate building structure as recited in claim 1, wherein each of said first five-sided building block, said first six-sided building block, said second five-sided building block, said second six-sided building block, said third five-sided building block, and said third six-sided building block consists essentially of metal material.

5. The arcuate building structure as recited in claim 1, wherein said arcuate building structure is comprised of at least fifteen of said five-sided building blocks.

6. The arcuate building structure as recited in claim 5, wherein said arcuate building structure is comprised of at least fifteen of said six-sided building blocks.

7. The arcuate structure as recited in claim 6, where the number of said five-sided building blocks in said structure is equal to the number of said six-sided building blocks in said structure.

8. The arcuate structure as recited in claim 7, wherein said means for connecting one of said five-sided blocks with one of said six-sided blocks is a substantially diamond-shaped plug.

9. The arcuate structure as recited in claim 8, wherein said substantially diamond shaped plug contains two substantially acute angles of about 60 degrees and two substantially obtuse angles of about 120 degrees.

* * * * *